US011950684B2

(12) United States Patent
Lee

(10) Patent No.: US 11,950,684 B2
(45) Date of Patent: Apr. 9, 2024

(54) AUXILIARY WEIGHT SUPPORTING DEVICE

(71) Applicant: ROPACE CO., LTD., Taoyuan (TW)

(72) Inventor: Chun-Hsien Lee, Taoyuan (TW)

(73) Assignee: ROPACE CO., LTD., Taoyuan (TW)

( * ) Notice: Subject to any disclaimer, the term of this patent is extended or adjusted under 35 U.S.C. 154(b) by 0 days.

(21) Appl. No.: 17/890,727

(22) Filed: Aug. 18, 2022

(65) Prior Publication Data

US 2023/0117038 A1 Apr. 20, 2023

(30) Foreign Application Priority Data

Oct. 20, 2021 (TW) ..... 110138863

(51) Int. Cl.
*A45F 3/10* (2006.01)
*A45B 1/00* (2006.01)
*A45F 3/00* (2006.01)

(52) U.S. Cl.
CPC ..... *A45F 3/10* (2013.01); *A45B 1/00* (2013.01); *A45F 2003/001* (2013.01); *A45F 2003/003* (2013.01)

(58) Field of Classification Search
CPC .. A45B 1/00; A45B 3/00; A45C 13/38; A45C 13/385; A45F 2003/001; A45F 2003/003; A45F 2003/045; A45F 3/00; A45F 3/047; A45F 3/08; A45F 3/10; B25J 9/0006
USPC ..... 224/633
See application file for complete search history.

(56) References Cited

U.S. PATENT DOCUMENTS

2012/0175393 A1* 7/2012 Wassel ..... A45F 3/10 224/272
2014/0259798 A1* 9/2014 Hollander ..... A45F 3/10 248/575

FOREIGN PATENT DOCUMENTS

CN 206085037 U * 4/2017
CN 111993387 A * 11/2020
CN 113172608 A * 7/2021
DE 3918346 A1 * 12/1992

OTHER PUBLICATIONS

CN-206085037-U Translation, Kang J, Apr. 2017 (Year: 2017).*
CN-111993387-A Translation, Li Y, Nov. 2020 (Year: 2020).*
DE 3918346 A1 Translation, Nussbaum, Dec. 1992 (Year: 1992).*
CN-113172608-A Translation, Zhu M, Jul. 2021 (Year: 2021).*

* cited by examiner

*Primary Examiner* — Peter N Helvey
*Assistant Examiner* — Matthew T Theis

(57) ABSTRACT

An auxiliary weight supporting device includes a back rack, a walking-stick and a connecting rod. The back rack is configured for the user to wear and for carrying an object. The walking-stick includes a main body and a gripping part and a contacting end configured at two ends of the main body respectively. The gripping part is configured for the user to hold, and the contacting end is configured to touch the ground when the user is walking. The connecting rod has a first end connected to the main body and a second end coupled to the back rack. The walking-stick is controlled by the user to support the ground and swings back and forth in accordance with the user's steps. The connecting rod drives the back rack to rise when the walking-stick swings backwards.

9 Claims, 4 Drawing Sheets

AUXILIARY WEIGHT SUPPORTING DEVICE

BACKGROUND OF THE INVENTION

1. Field of the Invention

The present invention relates to a weight supporting device, and more particularly, to an auxiliary weight supporting device combined with a walking-stick to support the user for carrying heavy objects.

2. Description of the Prior Art

The back rack is one of the common carrying tools in daily life. People can carry their belongings through the back rack to improve the convenience of activities. Therefore, the back rack can often be applied to field activities, tourism, mountain climbing, etc.

In general, the back rack includes a strap and/or a waist belt for the user to wear, so that the user can carry the back rack to carry the heavy objects. However, when the user carries a heavy object, the weight of the heavy object is mostly concentrated on the straps of the back rack. Therefore, the shoulders of the user bear most of the weight. If the user carries heavy objects for a long time, it may cause injuries such as hunchback or scoliosis. In addition, the knee joint is one of the important parts to support the upper body of the human body. When the knee joint needs to bear the weight of the upper body of the human body and the weight of the heavy objects, it will cause considerable pressure on the knee joint and it is easy to suffer from degenerative arthritis. Therefore, the current back rack cannot relieve and reduce the physical burden of the user when carrying heavy objects, thereby reducing the practicability and safety.

SUMMARY OF THE INVENTION

Therefore, the present invention provides an auxiliary weight supporting device to solve the problems of the prior art. In one embodiment of the present invention, the auxiliary weight supporting device is configured for supporting a user to carry an object. The auxiliary weight supporting device includes a back rack, a walking-stick and a connecting rod. The back rack is configured for the user to wear and for carrying the object. The walking-stick is configured for the user to hold to be propped against the ground in accordance with the user's steps to provide a supporting force. The walking-stick includes a gripping part, a main body and a contacting end. The gripping part and the contacting end are disposed on two ends of the main body respectively. The gripping part is configured for the user to hold, and the contacting end is configured to touch the ground when the user is walking. The connecting rod has a first end and a second end opposite to the first end. The first end is connected to the main body of the walking-stick, and the second end is coupled to the back rack. When the user wears the auxiliary weight supporting device and walks, the walking-stick is controlled by the user to be propped against the ground and swings back and forth in accordance with the user's steps, and the connecting rod drives the back rack to rise when the walking-stick swings backwards.

Wherein, the back rack includes a guide tube structure and a fixing component, and the auxiliary weight supporting device further includes a sliding block and an elastic component. The fixing component is configured in the guide tube structure. The sliding block is configured in the guide tube structure to slide in the guide tube structure, and the sliding block is coupled to the second end of the connecting rod. Two ends of the elastic component are connected to the sliding block and the fixing component respectively. When the walking-stick swings backwards, the walking-stick pushes the connecting rod to drive the sliding block to stretch or compress the elastic component, and the elastic component drives the fixing structure to lift the back rack.

In one embodiment, the elastic component is an extension spring, and the sliding block is located above the fixing component. When the walking-stick swings backwards and pushes the connecting rod to drive the sliding block to move, the extension spring is stretched by the sliding block and generates the elastic recovery force to pull and lift the fixing component.

In one embodiment, the elastic component is a compression spring, and the sliding block is located below the fixing component. When the walking-stick swings backwards and pushes the connecting rod to drive the sliding block to move, the compression spring is compressed by the sliding block and generates the elastic recovery force to push and lift the fixing component.

Wherein, the auxiliary weight supporting device further includes a crank component. The crank component includes a crank body and a rotating part, and the rotating part has an axis. The second end of the connecting rod is pivotally coupled to the crank body, and the rotating part is connected to the sliding block. When the walking-stick swings backwards and pushes the connecting rod, the connecting rod drives the crank body to rotate along the axis and drive the sliding block to move.

Furthermore, the rotating part is a bearing. The crank body has an elongated hole, and the second end of the connecting rod is pivoted to the elongated hole.

Wherein, the auxiliary weight supporting device of the present invention further includes two walking-sticks, two connecting rods, two guide tube structures, two fixing components, two sliding blocks and two elastic components configured on left side and right side of the back rack respectively. The sliding blocks comprise a left sliding block and a right sliding block. When the walking-stick on the left side swings backwards, it pushes the connecting rod on the left side to drive the left sliding block to move, and the elastic component on the left side lifts the back rack.

Furthermore, the left sliding block and the right sliding block alternately stretch or compress the elastic components on the left and right sides to continuously lift the back frame when the walking-sticks are controlled by the user to support the ground and swings back and forth in accordance with the user's steps.

Wherein, the auxiliary weight supporting device further includes a rotary limit component configured on the back rack. The rotary limit component is configured to rotate along the swinging direction of the walking-stick, and the rotary limit component includes a hole structure configured to sleeve the connecting rod. Wherein, when the walking-stick is controlled by the user to be propped against the ground and swings back and forth in accordance with the user's steps, the connecting rod moves in the hole structure and drives the rotary limit component to rotate.

Furthermore, the hole structure is a sleeve.

In summary, the auxiliary weight supporting device of the present invention can transmit the weight of the object from the back rack to the ground through the combination of the back rack, connecting rod and the walking-stick in accordance with the user's steps. Furthermore, the auxiliary weight supporting device of the present invention can transmit the weight of the object from the back rack to the ground alternately through the left and right walking-sticks and connecting rods, so as to reduce the burden of the user to carry heavy objects, thereby improving the practicability, comfort and safety. Moreover, the auxiliary weight supporting device of the present invention can also disperse the force other than the vertical direction through the crank component and the rotary limit component, so that the sliding blocks can only move in the vertical direction, thereby improving the practicability and lifting efficiency.

BRIEF DESCRIPTION OF THE APPENDED DRAWINGS

DETAILED DESCRIPTION OF THE INVENTION

For the sake of the advantages, spirits and features of the present invention can be understood more easily and clearly, the detailed descriptions and discussions will be made later by way of the embodiments and with reference of the diagrams. It is worth noting that these embodiments are merely representative embodiments of the present invention, wherein the specific methods, devices, conditions, materials and the like are not limited to the embodiments of the present invention or corresponding embodiments. Moreover, the devices in the figures are only used to express their corresponding positions and are not drawing according to their actual proportion.

Figure 1:
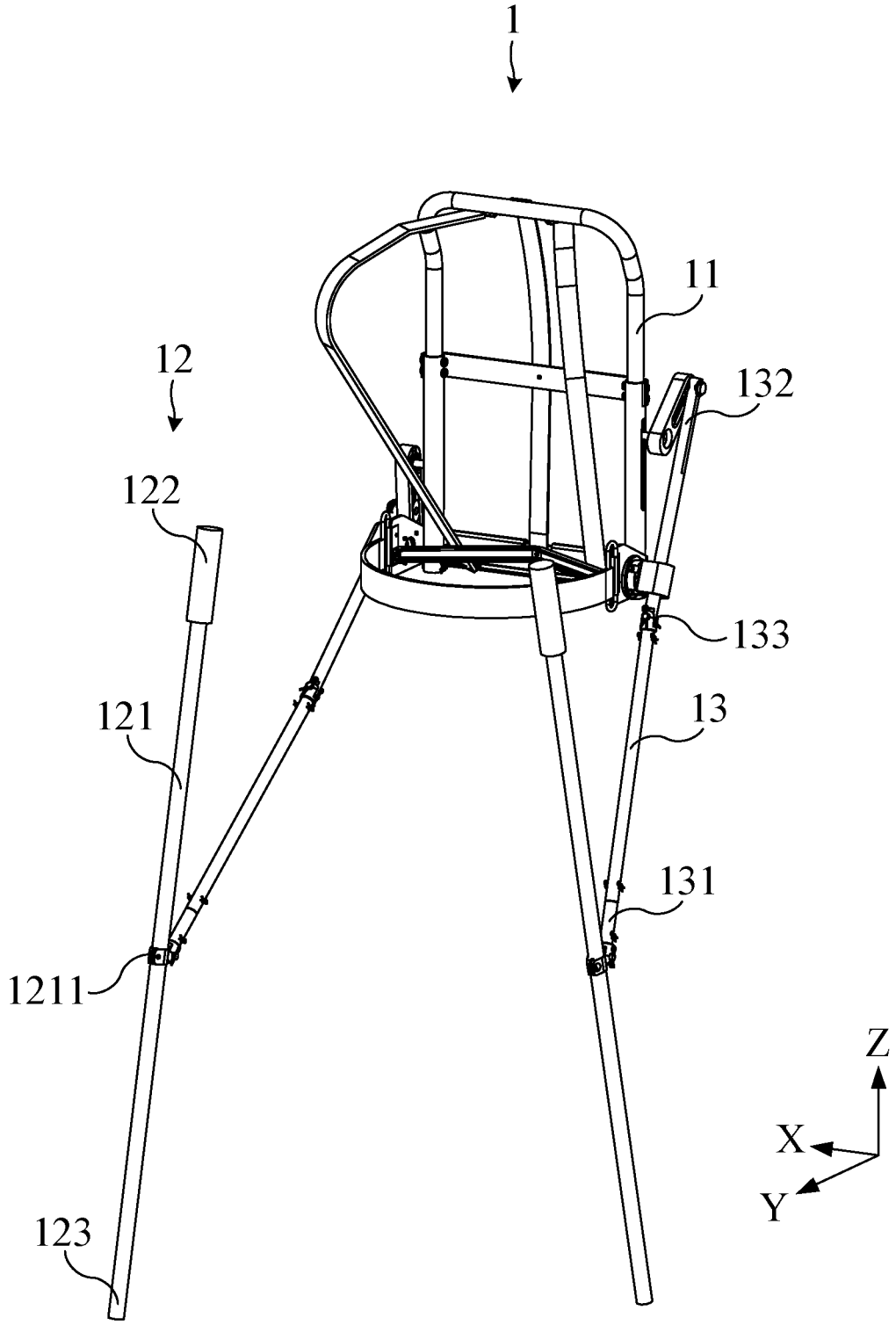
FIG. 1 is a structural schematic diagram illustrating an auxiliary weight supporting device according to an embodiment of the present invention.
Figure 2:
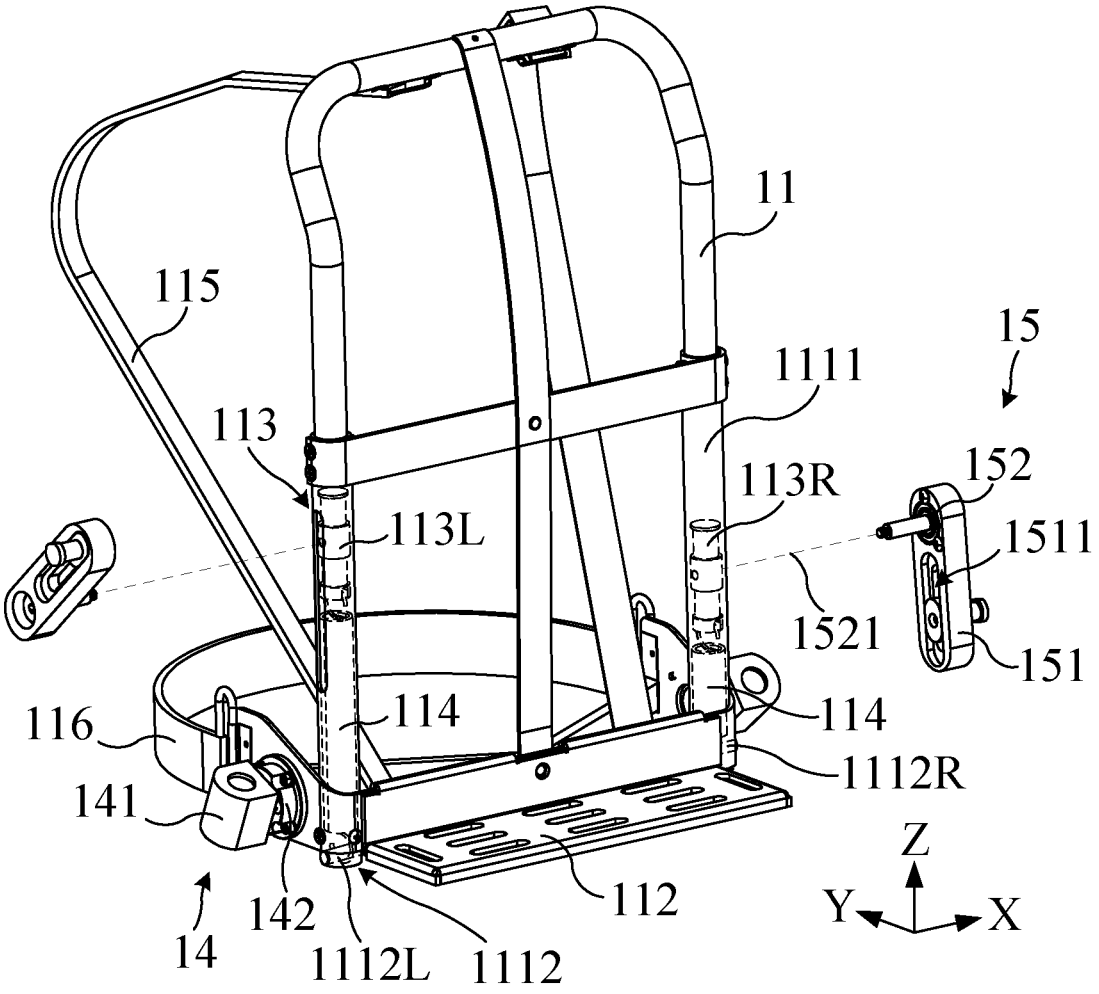
FIG. 2 is a structural schematic diagram illustrating the auxiliary weight supporting device in another perspective of FIG. 1.
Figure 3:
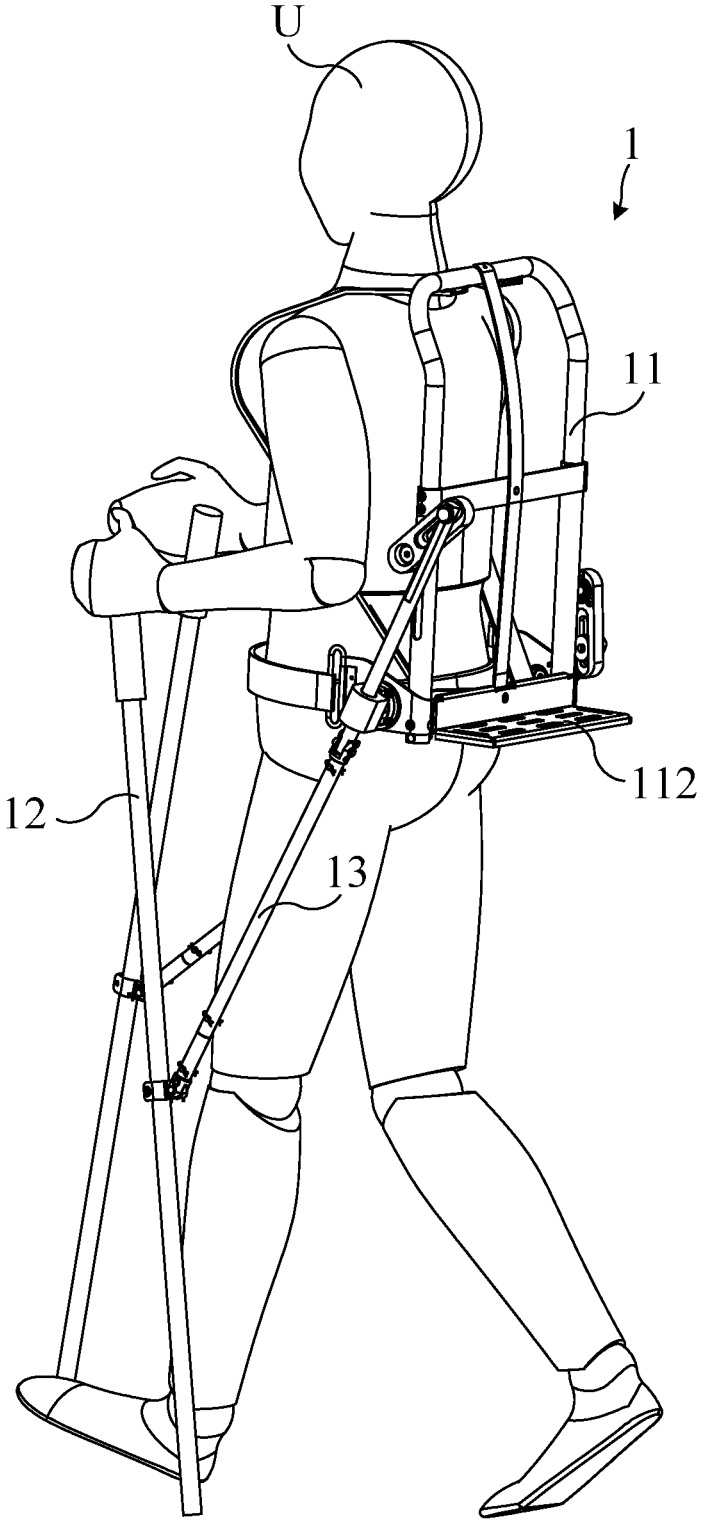
FIG. 3 is a schematic diagram illustrating a user wearing the auxiliary weight supporting device of FIG. 1.

Please refer to FIG. 1, FIG. 2 and FIG. 3. FIG. 1 is a structural schematic diagram illustrating an auxiliary weight supporting device 1 according to an embodiment of the present invention. FIG. 2 is a structural schematic diagram illustrating the auxiliary weight supporting device 1 in another perspective of FIG. 1. FIG. 3 is a schematic diagram illustrating a user U wearing the auxiliary weight supporting device 1 of FIG. 1. As shown from FIG. 1 to FIG. 3, the auxiliary weight supporting device 1 of the present invention is configured for supporting the user U to carry an object. In this embodiment, the auxiliary weight supporting device 1 includes a back rack 11, a walking-stick 12 and a connecting rod 13. The back rack 11 is configured for the user U to wear and for carrying the object. The walking-stick 12 is configured for the user U to hold to be propped against the ground in accordance with the user's steps. The connecting rod 13 is connected to the back rack 11 and the walking-stick 12 and configured to drive the back rack 11 to move according to the swing of the walking-stick 12 to upwardly support the object.

In practice, the back rack 11 can include a shoulder strap 115 and a waist belt 116, so that the user U can wear the shoulder strap 115 and the waist belt 116 to carry the back rack 11. The back rack 11 can fix and carry the object by suspending or bundling manner, but it is not limited thereto. In one embodiment, the back rack 11 can further include a detachable carrying base 112. The carrying base 112 can be fixed on the back rack 11 by suspending manner, and the object can be disposed on the carrying base 112. The back rack 11 can carry the object through the carrying base 112.

Furthermore, the back rack 11 includes a guide tube structure 1111 and a fixing structure 1112, and the auxiliary weight supporting device 1 further includes a sliding block 113 and an elastic component 114. The fixing structure 1112 is disposed in the guide tube structure 1111. The sliding block 113 is configured in the guide tube structure 1111 to slide in the guide tube structure 1111. Two ends of the elastic component 114 are connected to the sliding block 113 and the fixing component 1112 respectively. In practice, the guide tube structure 1111 can be a pipe configured along the Z-axis direction, and the sliding block 113 can be disposed in the pipe and slide upward and downward along the Z-axis direction. The fixing structure 1112 can be a cylindrical rod, and two ends of the cylindrical rod are fixed on the inner sidewall of the pipe. The fixing structure is not limited to cylindrical shape, and the shape of the fixing structure can be determined as designed. The elastic component 114 can be an extension spring and disposed in the pipe. As shown in FIG. 2, in this embodiment, the fixing structure 1112 is disposed on the bottom of the guide tube structure 1111, the sliding block 113 is disposed above the fixing structure 1112, and the elastic component 114 is disposed between the sliding block 113 and the fixing structure 1112. When the sliding block 113 moves upward (in +Z direction), the extension spring is stretched by the sliding block 113 and generates the elastic recovery force, and then the extension spring pulls and lifts the fixing structure 1112 according to the elastic recovery force to lift the back rack 11.

In this embodiment, the walking-stick 12 includes a main body 121, a gripping part 122 and a contacting end 123. The gripping part 122 and the contacting end 123 are disposed on two ends of the main body 121 respectively. The gripping part 122 is configured for the user U to hold, and the contacting end 123 is configured to touch the ground when the user U is walking. In practice, when the user U walks with the walking-stick 12, the user U can hold the gripping part 122 and swing the walking-stick 12 forward first to make the contacting end 123 to contact the ground in front of the user U. Then, the user U can use the contacting end 123 as a support point and apply a backward thrust to generate a supporting force, so that the user U can walk forward. Moreover, when the user U walks forward through the contacting end 123 of the walking-stick 12 propped against the ground, the contacting end 123 of the walking-stick 12 will approach the user U and the walking-stick 12 will swing backward along the Y-Z plane.

In this embodiment, the connecting rod 13 has a first end 131 and a second end 132 opposite to the first end 131. The first end 131 is connected to the main body 121 of the walking-stick 12, and the second end 132 is coupled to the back rack 11. In practice, the first end 131 of the connecting rod 13 can be fixed on a fixing position 1211 of the main body 121 of the walking-stick 12, and the second end 132 of the connecting rod 13 can be connected to the sliding block 113 of the back rack 11. When the walking-stick 12 is controlled by the user U to swing backwards, the walking-stick 12 can drive the second end 132 of the connecting rod 13 to move. Furthermore, the second end 132 of the connecting rod 13 can drive the sliding block 113 to move to lift the fixing component 1112 and the back rack 11. It should be noted that the length of the connecting rod can be determined by the user's requirements, and the fixing position of the first end of the connecting rod that fixed on the main body of the walking-stick can also be determined by the user's requirements.

In this embodiment, the auxiliary weight supporting device 1 further includes a rotary limit component 14 disposed on the back rack 11. The rotary limit component 14 can rotate in accordance with the swinging direction of the walking-stick and includes a hole structure 141. The hole structure 141 is configured to sleeve the connecting rod 13. In practice, as shown in FIG. 2, the rotary limit component 14 can be disposed on the side of the bottom position of the back rack 11, but it is not limited thereto. The rotary limit component 14 can include a rotary base 142, and the rotary base 142 can rotate along the Y-Z plane with the X axis as the center. The hole structure 141 can be a sleeve and can be disposed on the outer side of the rotary base 142. That is to say, the rotary base 142 is located between the back rack 11 and the hole structure 141, and the rotary base 142 can drive the hole structure 141 to rotate. Furthermore, the central axis of the hole of the hole structure 141 is parallel to the plane of rotation of the rotary base 142 (that is the Y-Z plane). Therefore, the connecting rod 13 disposed on the rotary base 142 can move in the hole structure 141 and rotate along the swinging direction of the walking-stick 12.

In addition, in this embodiment, the auxiliary weight supporting device 1 further includes a crank component 15 connected to the connecting rod 13 and the sliding block 113. The crank component 15 includes a crank body 151 and a rotating part 152 having an axis 1521. The crank body 151 is pivotally coupled to the second end 132 of the connecting rod 13, and the rotating part 152 is connected to the sliding block 113. In practice, the rotating part 152 can be a bearing, and the crank body 151 has an elongated hole 1511 located on the end portion relative to the rotating part 152. The second end 132 of the connecting rod 13 can be pivotally coupled to the elongated hole 1511 and move in the elongated hole 1511. Furthermore, the second end 132 of the connecting rod 13 can drive the crank body 151 to rotate around the axis 1521 through the elongated hole 1511. When the second end 132 of the connecting rod 13 moves upward (in +Z direction), the second end 132 can drive the crank body 151 to rotate around the axis 1521 and make the elongated hole 1511 located above the rotating part 152. Then, when the second end 132 of the connecting rod 13 continues to move upward, the crank component 15 will drive the sliding block 113 to move upward through the rotating part 152, thereby lifting the fixing structure 1112 and the back rack 11.

Please refer from FIG. 1 to FIG. 4. FIG. 4A to FIG. 4C are schematic diagrams illustrating the user U wearing the auxiliary weight supporting device 1 and walking according to an embodiment of the present invention. As shown in FIG. 1, FIG. 2 and FIG. 4A, when the user U is walking, the user U swings the walking-stick 12 forward first to make the contacting end 123 of the walking-stick 12 to contact the ground in front of the user U. At this time, the first end 131 of the connecting rod 13 moves forward in accordance with the walking-stick 12, the second end 132 of the connecting rod 13 moves toward the rotary limit component 14 and drives the crank body 151 to rotate around the axis 1521 to make the elongated hole 1511 be located below the rotating part 152.

Figure 4C:
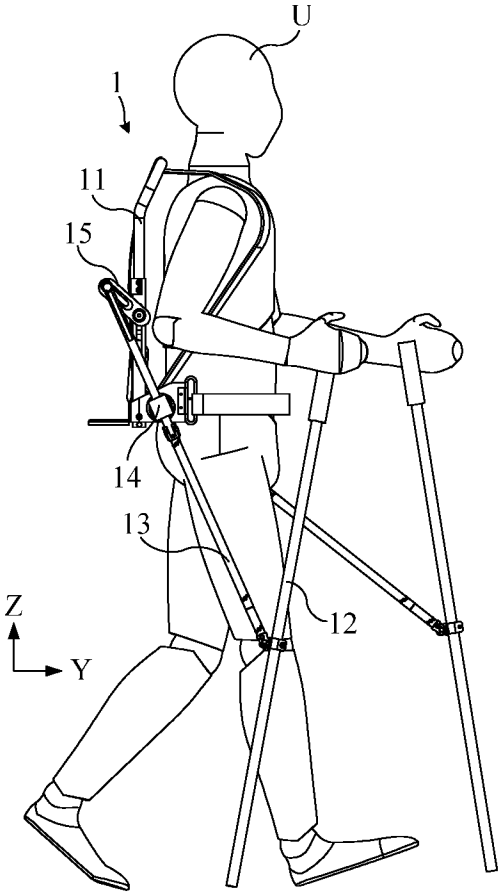
FIG. 4A to FIG. 4C are schematic diagrams illustrating the user wearing the auxiliary weight supporting device and walking according to an embodiment of the present invention.
Figure 4B:
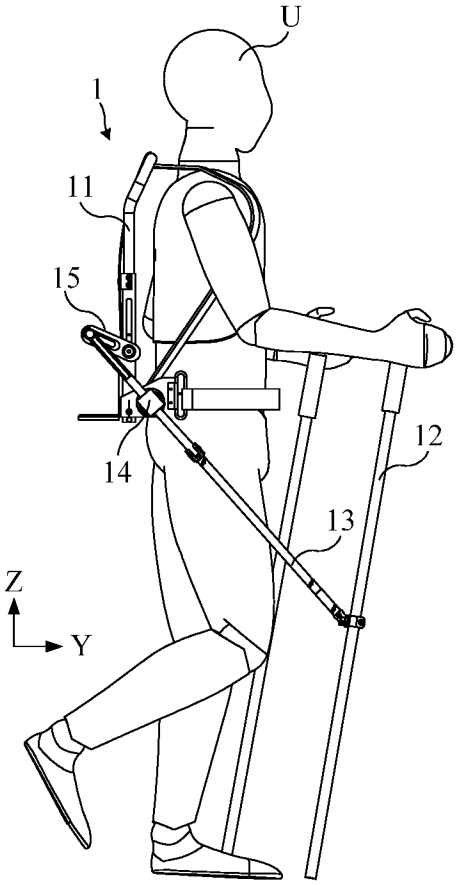
Figure 4A:
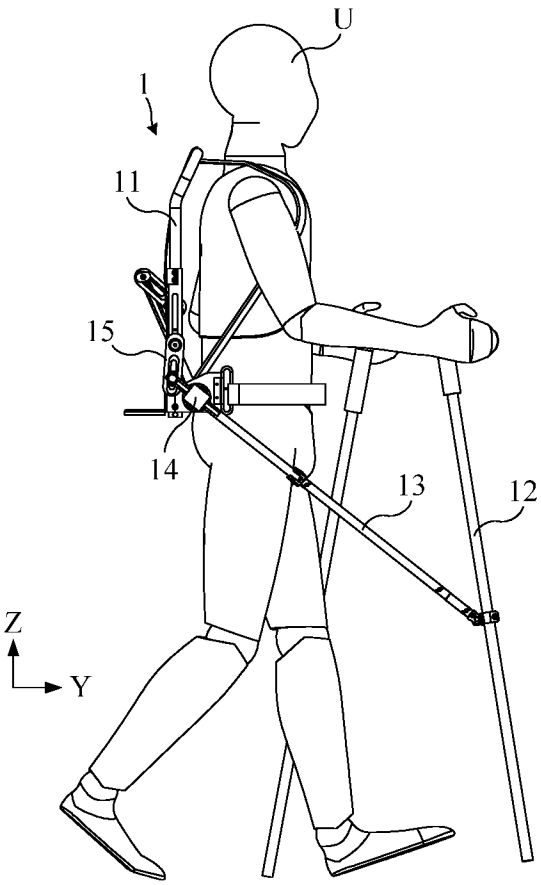

Then, as shown in FIG. 1, FIG. 2 and FIG. 4B, when the user U uses the contacting end 123 as a support point to apply the backward thrust and walks forward, the walking-stick 12 swings backward, and the distance between the walking-stick 12 and the user U is getting small. That is to say, the distance between the walking-stick 12 and the back rack 11 is getting small, and the distance between the first end 131 of the connecting rod 13 and the back rack 11 is getting small. At this time, the first end 131 of the connecting rod 13 moves toward the rotary limit component 14, and the second end 132 of the connecting rod 13 moves away from the rotary limit component 14. It means that the second end 132 of the connecting rod 13 moves toward the +Z direction. Furthermore, the second end 132 of the connecting rod 13 drives the crank body 151 to rotate around the axis 1521 to make the elongated hole 1511 be located above the rotating part 152.

Moreover, as shown in FIG. 1, FIG. 2 and FIG. 4C, when the user U further steps forward to make the distance between the first end 131 of the connecting rod 13 and the back rack 11 to be the shortest, the second end 132 of the connecting rod 13 continuously drives the crank body 151 to move upward. At this time, the crank component 15 drives the sliding block 113 of the back rack 11 to move upward through the rotating part 152, and the sliding block 113 stretches the elastic component 114 to lift the fixing component 1112 and the back rack 11. Finally, the part weight of the object disposed on the back rack 11 will be transmitted to the ground through the fixing component 1112, the elastic component 114, the sliding block 113, the crank component 15, the connecting rod 13 and the contacting end 123 of the walking-stick 12 sequentially. Therefore, the auxiliary weight supporting device of the present invention can transmit the weight of the object from the back rack to the ground through the combination of the back rack, connecting rod and the walking-stick and with the user's steps, so as to reduce the user's burden of carrying heavy objects, thereby improving practicability, comfort and safety.

In practice, when the walking-stick 12 is controlled by the user U to swing back in accordance with the user's steps and push the connecting rod 13, the second end 132 of the connecting rod 13 not only includes a force in the Z-axis direction, but also includes a force in the Y-axis direction in accordance with the swing of the walking-stick 12. At this time, the force in the Y-axis direction of the second end 132 can be configured to drive the crank component 15 to rotate. Therefore, when the connecting rod 13 drives the crank component 15 to move and the crank component 15 drives the sliding block 113 to move, the sliding block 113 only moves in the Z-axis direction without moving in the Y-axis direction, so as to reduce the frictional force between the sliding block 113 and the guide tube structure 1111, thereby increasing practicality and lifting efficiency.

Moreover, since the connecting rod 13 is disposed in the hole structure 141 of the rotary limit component 14 and the first end 131 of the connecting rod 13 is fixed on the main body 121 of the walking-stick 12, the rotary limit component 14 can limit the second end 132 of the connecting rod 13 to only move and rotate on Y-Z plane without moving in the X-axis direction, so that the sliding block 113 can only slide in the Z-axis direction. Furthermore, the connecting rod 13 further can include a joint component 133 disposed between the first end 131 and the second end 132. The joint component 133 can be a hinged structure configured to drive the first end 131 of the connecting rod 13 to swing in the X-axis direction. Different users U may have different habits and ways of using the walking-stick 12. Therefore, when the user U uses the walking-stick 12 to be propped against the ground and walk, the contacting end of the walking-stick 12 may not be located on the Y-Z plane but will move in the X-axis, thereby driving the first end 131 of the connecting rod 13 to move in the X-axis direction. At this time, the first end 131 of the connecting rod 13 only can drive the joint component 133 to rotate without driving the second end 132 of the connecting rod 13 to move in the X-axis direction, so that the sliding block 113 can only move in Z-axis direction to reduce the frictional force between the sliding block 113 and the guide tube structure 1111, thereby increasing practicality and lifting efficiency.

Please refer to FIG. 1 and FIG. 2. The auxiliary weight supporting device 1 of the present invention further can include two walking-sticks 12, two connecting rods 13, two guide tube structures 1111, two fixing components 1112, two sliding blocks 113 and two elastic components 114 disposed on left side and right side of the back rack 11 respectively. The sliding blocks 113 further can include a left sliding block 113L and a right sliding block 113R, and the fixing components 1112 further can include a left fixing component 1112L and a right fixing component 1112R. In practice, two hands of the user U can hold the two walking-sticks 12 respectively. The elastic component 114 on the left side is connected to the left sliding block 113L and the left fixing component 1112L, and the elastic component 114 on the right side is connected to the right sliding block 113R and the right fixing component 1112R. When the walking-stick 12 on the left side swings backwards, the connecting rod 13 on the left side is pushed to drive the left sliding block 113L to move upward. Similarly, when the walking-stick 12 on the right side swings backwards, the connecting rod 13 on the right side is pushed to drive the right sliding block 113R to move upward. Furthermore, when the two walking-sticks 12 are controlled by the user U to be alternately propped against the ground and swings back and forth in accordance with the user's steps, the left sliding block 113L and the right sliding block 113R alternately stretch the elastic components 114 on the left side and right side to alternately lift the left fixing component 1112L and the right fixing component 1112R, thereby lifting the back rack 11 continuously. Therefore, the auxiliary weight supporting device of the present invention can transmit the weight of the object from the back rack to the ground alternately through the left and right walking-sticks and connecting rods, so as to reduce the user's burden of carrying heavy objects, thereby improving the practicability, comfort and safety.

It should be noted that the auxiliary weight supporting device further can include two crank components and rotary limit components, which are respectively connected to the left sliding block and the right sliding block and connecting rods on the left side and the right side. The connections and structures of the walking-sticks, the connecting rods, the crank components, the rotary limit components, the guide tube structures, the fixing components, the sliding blocks and the elastic components on the left side and right side are the same with the connections and structures of the components of the aforementioned embodiment, it will not be described thereto.

The configuration of the sliding block of the back rack not only can be the type of the aforementioned embodiment, it also can be other types. In one embodiment, the fixing component is disposed in the top of the guide tube structure, the sliding block is disposed in the bottom of the guide tube structure, and the elastic component is a compression spring located between the fixing component and the sliding block. When the walking-stick is controlled by the user to swing back in accordance with the user's steps, the second end of the connecting rod drives the crank component to move upward, and the crank component drives the sliding block to move upward. At this time, the compression spring is compressed by the sliding block and generates the elastic recovery force, and then the compression spring pushes and lifts the fixing structure according to the elastic recovery force to lift the back rack. The part weight of the object disposed on the back rack will be transmitted to the ground through the fixing component, the elastic component, the sliding block, the crank component, the connecting rod and the contacting end of the walking-stick sequentially.

In summary, the auxiliary weight supporting device of the present invention can transmit the weight of the object from the back rack to the ground through the combination of the back rack, connecting rod and the walking-stick in accordance with the user's steps. Furthermore, the auxiliary weight supporting device of the present invention can transmit the weight of the object from the back rack to the ground alternately through the left and right walking-sticks and connecting rods, so as to reduce the user's burden of carrying heavy objects, thereby improving the practicability, comfort and safety. Moreover, the auxiliary weight supporting device of the present invention can also disperse the force other than the vertical direction through the crank component and the rotary limit component, so that the sliding blocks can only move in the vertical direction, thereby improving the practicability and lifting efficiency.

With the examples and explanations mentioned above, the features and spirits of the invention are hopefully well described. More importantly, the present invention is not limited to the embodiment described herein. Those skilled in the art will readily observe that numerous modifications and alterations of the device may be made while retaining the teachings of the invention. Accordingly, the above disclosure should be construed as limited only by the metes and bounds of the appended claims.

What is claimed is:

1. An auxiliary weight supporting device, configured for supporting a user to carry an object, the auxiliary weight supporting device comprising:

a back rack, configured for the user to wear and for carrying the object, the back rack comprising a guide tube structure and a fixing component, and the fixing component being configured in the guide tube structure;

a walking-stick, configured for the user to hold to be propped against the ground in accordance with the user's steps to provide a supporting force, the walking-stick comprising a gripping part, a main body and a contacting end, the gripping part and the contacting end being configured on two ends of the main body respectively, the gripping part being configured for the user to hold, and the contacting end being configured to touch the ground when the user is walking;

a connecting rod, having a first end and a second end opposite to the first end, the first end being connected to the main body of the walking-stick, and the second end being coupled to the back rack;

a sliding block, configured in the guide tube structure to slide in the guide tube structure, the sliding block being coupled to the second end of the connecting rod; and an elastic component, two ends of the elastic component being connected to the sliding block and the fixing component respectively;

wherein, when the user wears the auxiliary weight supporting device and walks, the walking-stick is controlled by the user to be propped against the ground and swings back and forth in accordance with the user's steps; when the walking-stick swings backwards, the walking-stick pushes the connecting rod to drive the sliding block to stretch or compress the elastic component, and the elastic component drives the fixing component to lift the back rack.

2. The auxiliary weight supporting device of claim 1, wherein the elastic component is an extension spring, and the sliding block is located above the fixing component, when the walking-stick swings backwards and pushes the connecting rod to drive the sliding block to move, the extension spring is stretched by the sliding block and generates the elastic recovery force to pull and lift the fixing component.

3. The auxiliary weight supporting device of claim 1, wherein the elastic component is a compression spring, and the sliding block is located below the fixing component, when the walking-stick swings backwards and pushes the connecting rod to drive the sliding block to move, the compression spring is compressed by the sliding block and generates the elastic recovery force to push and lift the fixing component.

4. The auxiliary weight supporting device of claim 1, further comprising a crank component, the crank component comprising a crank body and a rotating part, the rotating part having an axis, the second end of the connecting rod being pivotally coupled to the crank body, and the rotating part being connected to the sliding block, when the walking-stick swings backwards and pushes the connecting rod, the connecting rod drives the crank body to rotate along the axis and drive the sliding block to move.

5. The auxiliary weight supporting device of claim 4, wherein the rotating part is a bearing, the crank body has an elongated hole, and the second end of the connecting rod is pivoted to the elongated hole.

6. The auxiliary weight supporting device of claim 1, further comprising two walking-sticks, two connecting rods, two guide tube structures, two fixing components, two sliding blocks and two elastic components configured on left side and right side of the back rack respectively, wherein the sliding blocks comprise a left sliding block and a right sliding block, when the walking-stick on the left side swings backwards, the connecting rod on the left side it pushed to drive the left sliding block to move, and the elastic component on the left side is pushed to lift the back rack.

7. The auxiliary weight supporting device of claim 6, wherein the left sliding block and the right sliding block alternately stretch or compress the elastic components on the left and right sides to continuously lift the back frame when the walking-sticks are controlled by the user to be propped against the ground and swings back and forth in accordance with the user's steps.

8. The auxiliary weight supporting device of claim 1, further comprising a rotary limit component configured on the back rack, the rotary limit component being configured to rotate along the swinging direction of the walking-stick, and the rotary limit component comprising a hole structure configured to sleeve the connecting rod, wherein when the walking-stick is controlled by the user to be propped against the ground and swings back and forth in accordance with the user's steps, the connecting rod moves in the hole structure and drives the rotary limit component to rotate.

9. The auxiliary weight supporting device of claim 8, wherein the hole structure is a sleeve.

* * * * *